United States Patent [19]

Yurkanin

[11] 4,408,117

[45] Oct. 4, 1983

[54] IMPEDANCE HEATING SYSTEM WITH SKIN EFFECT PARTICULARLY FOR RAILROAD TANK CARS

[76] Inventor: Robert M. Yurkanin, 38 Hobart Gap Rd., Short Hills, N.J. 07078

[21] Appl. No.: 154,115

[22] Filed: May 28, 1980

[51] Int. Cl.[3] ..... F24H 1/20; H05B 3/82

[52] U.S. Cl. ..... 219/320; 174/111; 219/300; 219/301; 219/306; 219/315; 219/316

[58] Field of Search ..... 219/300, 301, 306, 315, 219/316, 310, 320, 321; 174/111

[56] References Cited

U.S. PATENT DOCUMENTS

| | | | |
|---|---|---|---|
| 2,044,580 | 6/1936 | Leach | 174/111 X |
| 2,536,747 | 1/1951 | Hynes | 219/315 |
| 2,802,520 | 8/1957 | Trabilcy | 219/306 X |
| 3,286,079 | 11/1966 | Hynes et al. | 219/310 |
| 3,293,407 | 12/1966 | Ando | 219/301 |
| 3,410,977 | 11/1968 | Ando | 219/10.49 |
| 3,448,202 | 6/1969 | Whitehead | 174/111 X |
| 3,515,837 | 6/1970 | Ando | 219/10.49 |
| 3,522,440 | 8/1970 | Ando | 307/38 |
| 3,523,177 | 8/1970 | Ando | 219/300 |
| 3,524,966 | 8/1970 | Ando | 219/300 |
| 3,552,482 | 1/1971 | Ando | 165/1 |
| 3,571,561 | 3/1971 | Ando | 219/300 |
| 3,575,581 | 4/1971 | Ando | 219/301 |
| 3,591,770 | 7/1971 | Ando | 219/540 |
| 3,598,959 | 8/1971 | Ando | 219/300 |
| 3,617,699 | 11/1971 | Othmer | 219/301 X |
| 3,622,731 | 11/1971 | Ando | 219/10.49 |
| 3,629,551 | 12/1971 | Ando | 219/300 |
| 3,630,038 | 12/1971 | Ando | 61/72.1 |
| 3,632,975 | 1/1972 | Ando et al. | 219/300 |
| 3,632,976 | 1/1972 | Ando | 219/301 |
| 3,665,154 | 5/1972 | Ando | 219/301 |
| 3,678,243 | 7/1972 | Ando et al. | 219/301 |
| 3,755,650 | 8/1973 | Ando | 219/301 |
| 3,766,357 | 10/1973 | Koester | 219/300 |
| 3,777,117 | 12/1973 | Othmer | 219/300 |
| 3,780,250 | 12/1973 | Ando | 219/10.49 |
| 3,974,398 | 8/1976 | Othmer | 307/147 |
| 3,975,617 | 8/1976 | Othmer | 219/300 |
| 3,978,709 | 9/1976 | Ando | 73/40.5 |

FOREIGN PATENT DOCUMENTS

| | | | |
|---|---|---|---|
| 919184 | 10/1954 | Fed. Rep. of Germany | 219/300 |
| 48-34085 | 10/1973 | Japan | 219/300 |
| 540102 | 12/1976 | U.S.S.R. | 219/300 |

*Primary Examiner*—A. Bartis

*Attorney, Agent, or Firm*—Cifelli, Frederick & Tully

[57] ABSTRACT

An impedance skin effect heating system for tanks or vessels containing a liquid includes a heating unit having a rigid outer pipe conductor mounted through an opening in the tank and extending therein, to be immersed in the liquid and a rigid central conductor supported within the outer pipe conductor by spaced-apart temperature resistant asbestos insulation discs. The insulation discs are held to the central conductor by flanking metal collars welded to the central conductor for insertion of the central conductor into the outer pipe conductor while maintaining the desired position of the insulation discs on the central conductor. An end cap is welded to both the outer conductor pipe and the central conductor, sealing the ends thereof and establishing electrical contact therebetween. The central and outer pipe conductors connected to a source of AC power, usually through a transformer, to cause the outer pipe conductor and central conductor to generate heat via impedance, reactance, and hysteresis and eddy currents. A plurality of such heating units may be immersed in the tank and powered by a three-phase AC power source with the plurality of units being balanced on a three-phase transformer. An additional heat fluid transfer heating subsystem may be provided by pumping a heat transfer fluid through a central conductor formed as a pipe, and utilizing tubing to carry the heat transfer fluid to the desired point of use. The central conductor, outer pipe conductor and end cap are designed to have sufficient thickness that the current flow therethrough is concentrated by skin effect on the inside surface of the pipe conductor and end cap and on the outer surface of the central conductor, so that the surfaces of the conductors and end cap contacted by the liquid to be heated or the heat transfer fluid have no voltage or current thereon.

15 Claims, 8 Drawing Figures

POWER TRANSFORMER

POWER TRANSFORMER

IMPEDANCE HEATING SYSTEM WITH SKIN EFFECT PARTICULARLY FOR RAILROAD TANK CARS

BACKGROUND OF THE INVENTION

This invention relates to impedance heating apparatus for heating the contents of tanks and vessels, and particularly tank cars such as railroad tank cars.

Railroad tank cars are often used to transport substances which are solid or very highly viscous at ambient temperatures. Such substances include coal tar pitch, asphalt and low-sulphur oil, among others. These substances must be heated in order to be pumped and transferred through pipes and also must be heated when stored in tanks so that they can be pumped out for further transporting or use.

In the instance of railroad tank cars, such substances are generally heated prior to being placed in the tank car and thus enter the tank car in a relatively liquid state. Despite providing the tank cars with thermal insulation, there are heat losses through the tank wall from the substance while it is in transit. Therefore, it is necessary to heat the substance while it is in the tank car, and particularly prior to pumping it out, which requires a relatively low viscosity. To this end, railroad tank cars have in the past been equipped with heating devices in the form of electrical resistance heating elements placed in tubes extending into the interior of the tank. Although the electrical resistance heater elements are capable of providing substantial amounts of heat within the tank, they have a number of drawbacks. Perhaps the most serious of these is the relative fragility of the electrical resistance heaters, whereby they often fail due to breakage from shock loads and vibrations involved in the use of railroad tank cars. Resistance heaters are all subject to fatigue failures or burnouts.

Also, by way of background of this invention, impedance heating of pipelines is known. In its simplest form, impedance heating comprises connecting a pipeline in a circuit to which alternating current source is applied, thereby utilizing the pipeline itself as a resistance heating element. The efficiency of impedance heating of pipelines is improved by positioning an insulated electrical cable parallel to the pipeline for completing the circuit through the pipeline. This sets up self-inductance between the pipeline and return cable, as well as utilizing hysteresis and eddy currents which would otherwise be lost, both of which increase the efficiency of the heating effect. A low voltage, e.g. 80 volts or less, and high amperage AC power supply is used, and the voltage appears on the exterior of the pipeline due to the electrical skin current conductive effect. Therefore, the heat is also generated on the outside of the pipeline, and is conducted through the pipeline to heat the substances flowing therethrough. The pipeline is generally surrounded by thermal insulation to prevent heat losses. The heat generated in the conductor itself is low, inasmuch as the conductor is normally copper or aluminum which has a low resistance and since the insulated conductor is outside the pipeline where any heat generated can dissipate rapidly.

A skin effect current tracing system has also been employed to heat pipelines, and particularly large pipelines where the skin of the pipe itself is too large to be used as the resistance in an impedance heating system. A small diameter heat generating pipe is welded to and "traces" the pipeline, and an insulated conductive cable is deployed on the interior of the smaller heat generating pipe, being electrically connected to the heat generating pipe at one end so that the heat generating pipe and insulated conductive cable are in series. An alternating current at relatively high voltage, e.g. 500–2,000 or more volts, may be applied, as required by the length of the heat generating pipe. The skin effect causes the current and voltage on the heat generating pipe to be on the interior surface thereof, with the exterior of the heat generating pipe thereby being at or near zero voltage for safety reasons. The heat generating pipe is heated by the current flow near the inside surface thereof, and the heat is thermally conducted to the larger pipeline. One of the most important limits on this type of heating system is the integrity of the insulation surrounding the conductive cable within the heat generating pipe, which breaks down at high temperatures. The insulation is also subject to damage when the cable is pulled into the heat generating pipe.

It will be apparent that large vessels, such as railroad tank cars, have surface areas which are too large to use the tank itself as the conductor in an impedance heating system. Further, the skin effect current tracing system can be employed by placing several heat generating pipes on the exterior of the tank, but there are obvious problems with trying to heat a large volume tank from the outside in, particularly in trying to insulate against heat losses and in the number of trace pipes required. Therefore, neither of these systems are wholly satisfactory for application to systems such as railroad tank cars.

SUMMARY OF THE INVENTION

According to the invention herein, a vessel or tank, and particularly a railroad tank car, is provided with at least one and preferably a plurality of impedance heating units comprising pipes extending through the tank wall into the interior of the tank, where they are surrounded by the substance to be heated. The outer pipe comprises the first conductor of the impedance heating unit, and may be fabricated of carbon steel, nickel or stainless steel. A second central conductor, which may comprise either a pipe or a solid rod of similar material, is inserted in the outer pipe and held spaced apart and generally concentric therewith by a plurality of highly temperature resistant insulation discs. The insulation discs may be asbestos for this purpose. The insulation discs are held at longitudinally spaced apart positions on the central conductor by collars extending radially therefrom, and the insulation discs are inserted into the outer conductor together with the central conductor. An end cap is welded to the inserted end of the central conductor and to the end of the outer pipe within the tank, establishing electrical connection between the outer pipe and central conductor and also sealing the interior of the outer pipe from the interior of the tank.

At the end of the outer conductor pipe which terminates at or adjacent the wall of the tank, the central conductor extends through an apertured packing nut which holds plural insulation discs in loose array such that they permit steam and vapors to escape from the interior of the outer pipe, but largely prevent the ingress of water and other contaminents. The extending end of the central conductor is provided with a terminal for attaching a cable to a current source.

Alternating current is applied, preferably from the secondary of a transformer at about 55 or less volts, with the outer conductor and the central conductor connected in the circuit in series. More particularly, a cable may connect a tap on the secondary side of the transformer to the end of the central conductor protruding from the outer conductor pipe, and the outer conductor pipe may be grounded to the wall of the tank. Due to the skin effect of electrical current flow, current flows in the inner skin of the outer conductor pipe and the outer skin of the central conductor, and no voltage appears on the outer surface of the outer conductor pipe which is exposed to the substance within the tank. Both the outer pipe and the central conductor generate substantial portions of heat, and because of the concentric parallel configuration of the conductors, the added efficiency in heating through self-inductance and hysteresis and eddy currents are realized.

The heat generated in the central conductor is transmitted to the outer conductor pipe by thermal conductivity of the air between the conductors and by radiant heating. The heat generated in the outer conductor pipe and the heat received from the central conductor is transmitted to the substance surrounding the outer pipe by thermal conductivity. Because both the outer conductor pipe and the central conductor are heavy guage (compared to insulated wire conductors), no danger of these conductors burning out is present. Because of the configuration of the conductors, their separation by insulation discs and material of the insulation discs, no danger of insulation failure is present in this impedance heating unit either. Thus, the impedance heating units are able to achieve a high and adequate output of heat without danger of burning out. The structure is rugged and able to withstand the rigors of transportation to which a railroad tank car is subjected.

In a preferred embodiment, there are six pipes extending into a railroad tank car, and three-phase alternating current is used to heat the six pipes in three parallel connected pairs.

A further feature of the invention herein includes providing the central conductor in the form of a pipe and pumping a heat transfer medium therethrough. The heat transfer fluid is further circulated to provide either localized heating of valves, pump inlets or the like, localized heating of the substance remote from the impedance heating units, or for other desirable purposes.

Accordingly, it is a principal object of the invention herein to provide improved heating apparatus for use in tanks, and particularly in railroad tank cars.

It is an additional object of the invention herein to provide an impedance heating system for railroad tank cars which can be retrofitted into existing tank car structures at minimal expense.

It is another object of the invention herein to provide an impedance heating system for railroad tank cars which is rugged and reliable, and yet efficient in its use of power.

It is a further object of the invention herein to provide an impedance heating system for tank cars and the like which provides for heating remote areas via a heat transfer fluid subsystem.

Additional objects and features of the invention herein will in part be obvious and will in part appear from a perusal of the following description of the preferred embodiments and the claims, taken together with the drawings.

DRAWINGS

The same reference numerals refer to the same elements throughout the various Figures.

DESCRIPTION OF PREFERRED EMBODIMENT

Figure 1:
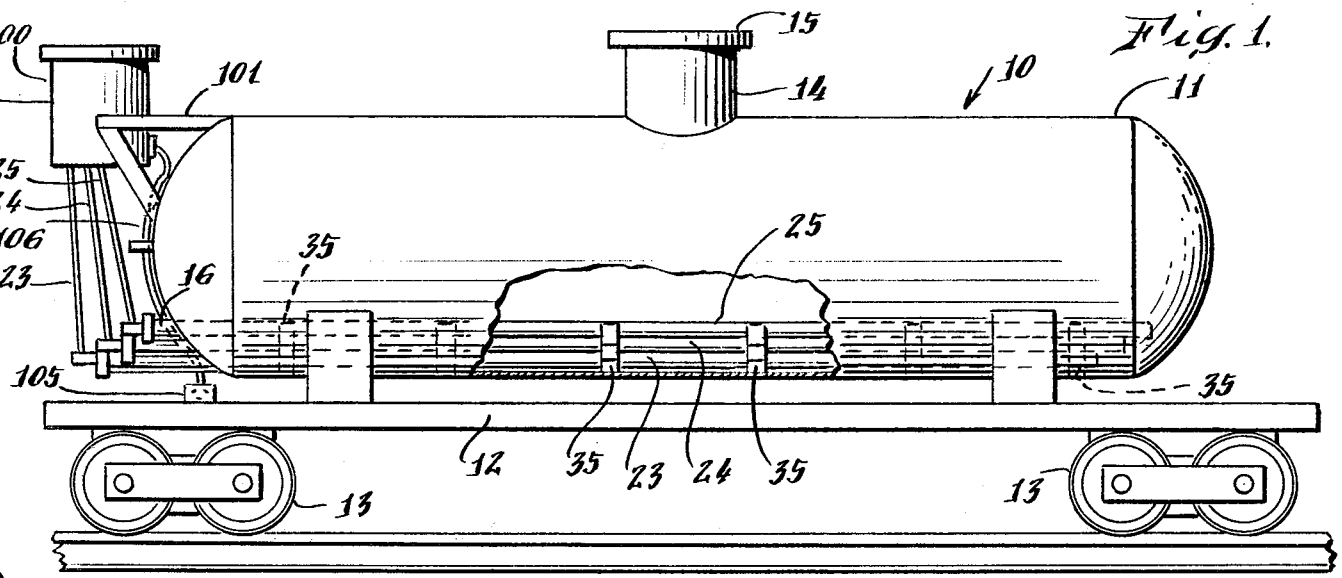
FIG. 1 is a side elevation view of a railroad tank car having an impedance heating system according to the invention herein.
Figure 2:
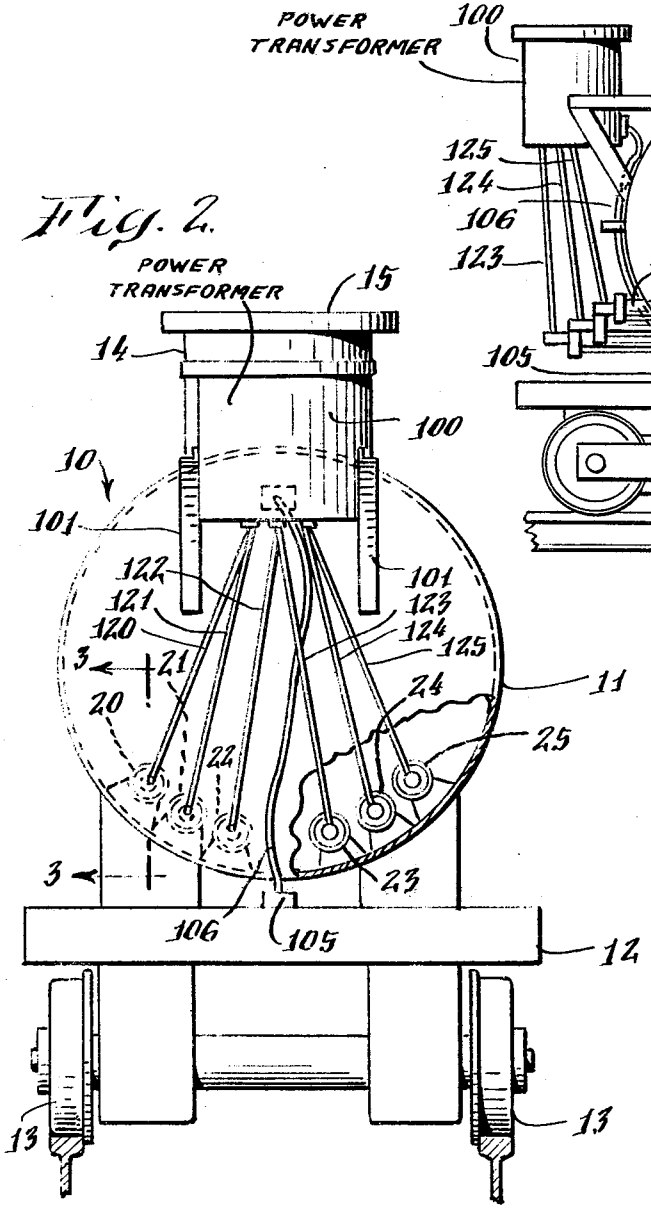
FIG. 2 is an end elevation view of the railroad tank car of FIG. 1, partially cut away.

With reference to FIGS. 1 and 2, a railroad tank car 10 generally comprises an elongated cylindrical tank 11 mounted to a frame or bed 12, which mounts wheels 13 forming a part of a suspension system adapting the tank car 10 for rolling transport on rails. The tank 11 includes a filler neck 14 sealed by a cover 15. The tank car 10 is shown very schematically in FIG. 1 and it will be understood that the tank 11 may be thermally insulated, that the detail of the mounting of the tank on the frame, the suspension system and axles, etc., are all shown generally, and that the tank car 10 also has couplers, brakes, etc., and the other usual components of a railroad car which are well-known in the art.

Figure 3:
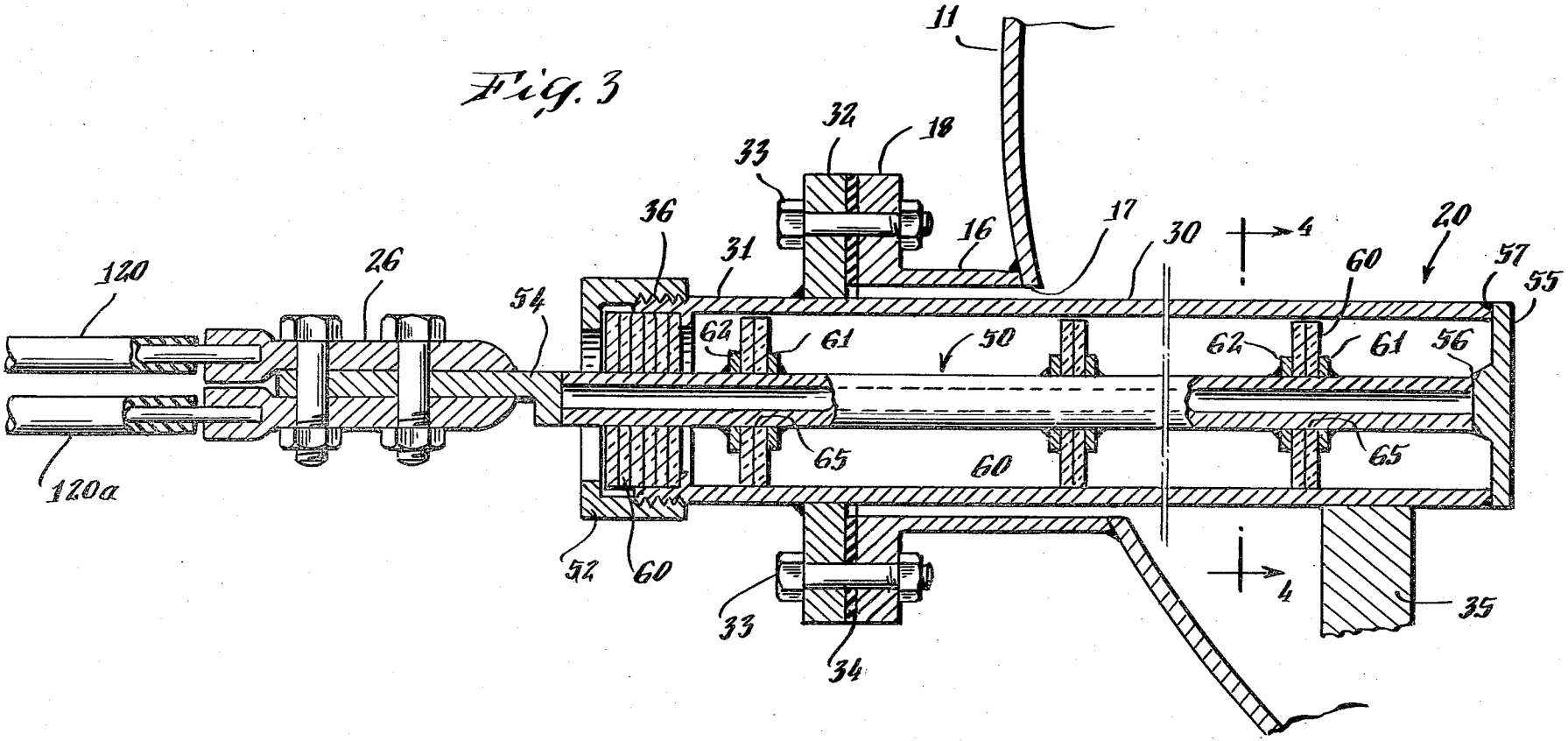
FIG. 3 is an enlarged longitudinal sectional view of one of the impedance heating units of the impedance heating system of FIG. 1, taken along the lines 3—3 of FIG. 2.

Many tank cars are already equipped with electrical resistance heaters for heating the contents of the tank 11. As best seen in FIGS. 1–3, a plurality of pipes, including pipe 30, are mounted to the wall of the tank 11. An end portion 31 of the pipe extends out of the tank and a major portion of the pipe extends into the tank, preferably spaced apart from but fairly near the lower portion of the tank 11. The mounting of the pipe 30 is shown in detail in FIG. 3, and the remainder of pipes, typically five others for a total of six, are similarly mounted. The tank 11 has an outwardly protruding sleeve 16 welded to the periphery of an opening 17 through the wall of the tank. The sleeve 17 has a radially outwardly extending flange 18 at the distal end thereof. The end portion 31 of pipe 30 extending out of the tank 20 has a collar 32 welded to the exterior thereof, and the collar 32 and the flange 18 are provided with aligned openings for receiving bolts 33 which thereby secure the pipe 30 to the tank 11. A gasket 34 is provided to prevent leakage. A plurality of supports 35 are deployed between the pipe and the wall of the tank 11 for supporting the pipe 30. The pipe 30 (and the other five pipes) are typically fabricated of carbon steel, and may be "Schedule 40" pipes having a four inch inside diameter, a four and one-half inch outside diameter and a length of approximately forty feet.

In the prior art, electrical resistance heaters were inserted in the pipes, including pipe 30. The electrical resistance heaters were typically adapted to use three-phase alternating current at 50 to 60 cycles and 460 volts, and the tank car 11 is provided with a plug connector 105 adapted to receive such electrical power. The electrical resistance heaters were not operated while the car was in transit, but were utilized at terminals prior to and after transit, where power supplies are located.

As noted above, the electrical resistance heaters were not entirely satisfactory and an object of this invention is to provide an improved means for heating the contents of railroad tank cars using impedance heating principles. To this end, the pipe 30 is used as an outer conductor in an impedance heating unit 20. It will be appreciated that by so using the pipe 30, the retrofitting of impedance heating units in tank cars which were previously equipped with electrical resistance heaters is substantially simplified.

The impedance heating unit 20 further comprises a central conductor 50 which may be either a pipe or a rod. In the preferred embodiment disclosed herein, the central conductor 50 is a "Schedule 160" pipe having an inside diameter of one and one-half inches and an outside diameter of two and three-eighths inches, the pipe being fabricated of carbon steel. Nickel and stainless steel would also be suitable materials for the central conductor 50 as well as for the outer conductor pipe 30.

Figure 4:
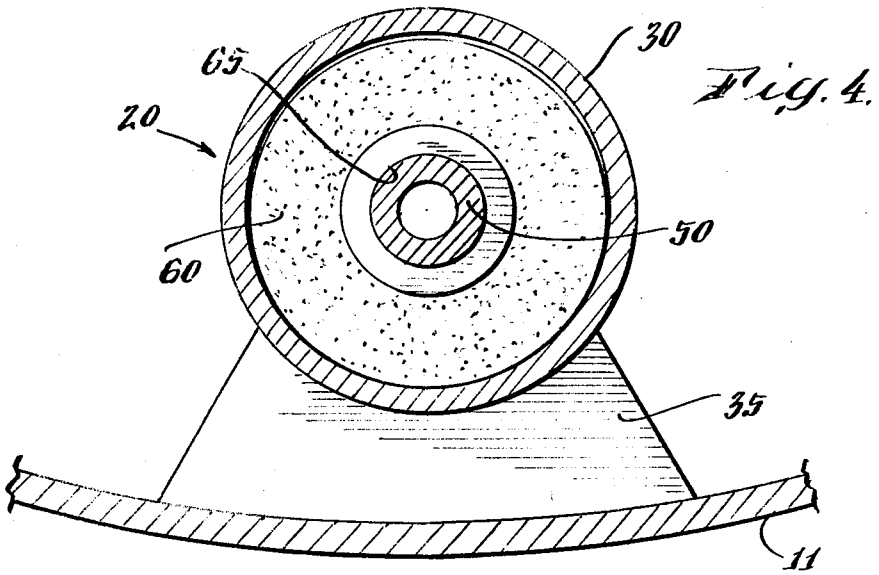
FIG. 4 is a sectional view of the impedance heating unit of FIG. 3 taken along the lines 4—4 of FIG. 3.

The central conductor 50 is supported concentrically inside the outer pipe conductor 30 by insulation discs 60. The insulation discs 60 are deployed at spaced-apart intervals along the length of the outer pipe 30 and central conductor 50, the insulation discs 60 having central openings 65 through which the central conductor passes. In the embodiment shown, the insulation discs 60 are fabricated of asbestos, and are utilized in pairs, each pair being held adjacent each other and in position along the length of the central conductor 50 by flanking peripheral collars 61 and 62. In assembling the impedance heating unit 20, the insulation discs 60 and collars 61 and 62 are placed on the central conductor 50 and adjusted to their desired positions. Spacings of approximately one to two feet between the pairs of discs is sufficient to prevent sagging of the central conductor and heavy loadings on the outer conductor pipe. The collars 61 and 62 are then secured in place, such as by welding. The central conductor 50 with the insulation discs 60 installed thereon is inserted into the outer conductor pipe 30, the collars maintaining the insulation discs at the proper longitudinal positions during this process. As best seen in FIG. 4, it is preferable that the insulation discs 60 have an outside diameter slightly less than the inside diameter of the outer conductor pipe 30, in order that the insulation discs may slide easily into the outer conductor 30. It will be appreciated that other high temperature resistant materials may be used for the insulation discs, and porcelain is one suitable material for stationary tanks or vessels.

An end plate 55 electrically connects the outer conductor pipe 30 with the central conductor 50. The end plate 55 comprises a circular disc, also fabricated of carbon steel, welded at its central portion to the central conductor 50 as indicated at 56 and welded at its periphery to the outer conductor pipe 30 as indicated at 57, thereby establishing the desired electrical connection and also sealing the interior of the outer conductor pipe 30 from the contents of the tank 20. As a matter of fabrication, the central conductor 50 can be extended through and beyond the inner end of the outer conductor pipe 30 for welding the end plate 55 thereto, the inner conductor 50 can then be withdrawn until the end plate 55 makes contact with the outer conductor 30, and thereafter the end plate 55 be welded to the outer conductor 30.

The end 31 of the outer conductor 30 is provided with threads 36 for receiving an apertured cap nut 52. The packing nut 52 loosely retains a plurality of the insulation discs 60 near the end 31 of conductor pipe 30. The central conductor 50 extends through the apertured cap nut 52 and has an L-shaped terminal 54 welded to the protruding end. The cap nut 52 and insulation discs 60 held at the end of the outer conductor pipe serve to substantially weatherproof the interior of the outer conductor pipe 30, while still permitting steam vapors and the like to escape.

Each of the other five pipes mounted to the tank 11 and originally receiving electrical resistance heaters may be provided with a central conductor, insulation discs and collars, end caps etc., in the same manner as shown in FIG. 3 for the outer conductor pipe 30, thereby providing five additional impedance heating units 21–25 for the tank car 10.

A transformer 100 is mounted to the tank car 10, e.g. on a bracket 101 connected thereto. As will be discussed more fully below, the secondary side of the transformer 100 is connected to the central conductors of the impedance heating units 20–25 by insulated electrical cables 120–125, respectively. As best seen in FIG. 3, an end terminal 26 of the insulated electrical conductor cable 120 is connected to the terminal 54 of the central conductor 50. A second cable **125*a* may "double" the first cable 120 in order to provide sufficient current carrying capability without overheating the cables. Although not shown, it will be appreciated that the terminals 26, 54 and the exposed portion of the central conductor 50 are covered by an insulating boot or the like for safety. The primary side of the transformer 100 is connected by a supply cable 106 to the plug connector 105 mounted on the frame 12 of the railroad car, and the AC power supply may be connected to the transformer via plug connector 105** in order to operate the impedance heating units.

Figure 5:
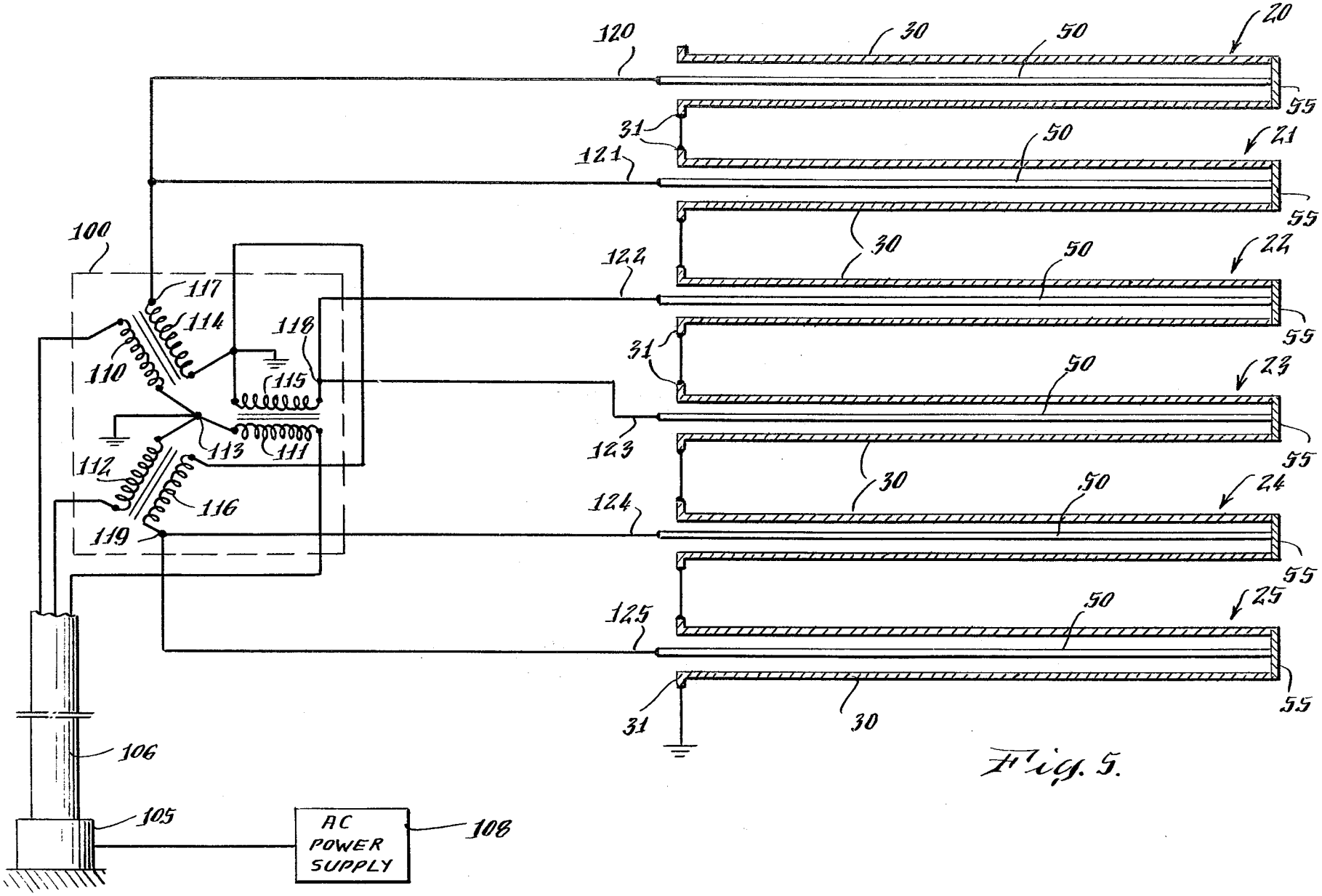
FIG. 5 is an electrical circuit diagram for the impedance heating system.

With reference to FIG. 5, in the preferred embodiment disclosed herein a three-phase 50 to 60 cycle AC power supply 108 is utilized, and accordingly, the transformer 100 is of the three-phase type, having primary windings 110, 111 and 112 Y-connected with a neutral point at 113, which is grounded to the tank car 10. The tap 117 of secondary winding 114 is connected by cable 120 to the central conductor 50 of the impedance heating unit 20, and the protruding end 31 of the outer conductor 30 is grounded to the tank car 10. Inasmuch as there are six impedance heating units, the tap 117 of secondary winding 114 is also connected to the central conductor of the impedance heating unit 21, whereby units 20 and 21 are in parallel. The tap 118 of secondary winding 115 is similarly connected to the impedance heating units 22 and 23 via cables 122 and 123, respectively, and tap 119 of secondary winding 116 is connected to the impedance heating units.

When the AC power is supplied to the transformer 100 (which reduces the voltage), alternating current flows in the series connected central conductor 50 and outer conductor pipe 30 of the impedance heating unit 20 as well as in the other impedance heating units 21–25.

It is well-known that when an alternating current flows through a conductor, the current concentrates on the surfaces of the conductor, and this is known as a so-called "skin effect". The depth of the skin S in centimeters in which the current flows can be expressed by the following equation:

$$S = 5030\sqrt{\delta/\mu f}$$

where $\delta$ is the resistivity of the conductor in ohms per centimeter, $\mu$ is a permeability factor and f is the frequency of the current in cycles per second. When an alternating current is supplied to a central conductor inserted within an outer conductor pipe, the current flow through the outer pipe is caused to concentrate on the inner wall portion thereof by the skin effect and there will be substantially no current flow or voltage on the outer surface of the outer conductor pipe so long as the following relationships are satisfied: $T>S$; $D>>S$; and $L>>D$; wherein D is the inside diamter of the pipe in centimeters, T is its thickness in centimeters and L is its length in centimeters. These conditions are easily satisfied by the outer conductor pipe 30.

Accordingly, there is substantially no current flow or voltage on the outside surface of the outer conductor pipe 30, but a substantial current flow on the inner surface, which creates heat which is transmitted by thermal conductivity through the outer conductor pipe 30 to the contents of the tank. Inasmuch as the central conductor 50 is also a pipe (or rod) of ferromagnetic metal having approximately the same resistivity as the outer pipe 30, heat is also produced by the current flow through the central conductor 50. The skin effect is also present in the central conductor 50, the current flowing and producing heat in an outer surface thereof. Heat from the central conductor 50 is transferred to the outer conductor pipe 30 by radiant heating and by thermal conductivity of the air in the space between the outer and central conductors. The insulation discs, being spaced apart and occupying a relatively small volume, do not impede the heat transfer.

Because of the concentric parallel configuration of the central conductor 50 and outer conductor pipe 30, heating is the result of the resistance of the pipes, but is also enhanced by the reactance inherent in the system, the reactance being defined as the opposition to self-inductance caused by the rapid reversals in magnetic flux around the two conductors. Eddy currents and hysteresis also contribute to heat production.

It should be noted that the end plate 55 is maintained spaced apart from the walls of the tank 20 upon installation of the impedance heating system 20, so that the longitudinal expansion of the outer conductor pipe 30 during heating may be accommodated.

In the preferred embodiment described herein, the power supply 108 is provided at 480 volts, resulting in an applied power of 160 KVA. The voltage in the transformer secondary is maximum 42 volts phase to phase. In the six unit system described, wherein each of the units is approximately forty feet long, heat power is therefore on the order of 650 watts per foot. The current flowing in the conductors is approximately 1,000 amps at start up, when both the heating units and substances in the tank car are cold, and this drops to approximately 720 amps as the units heat up. The impedance heating units are approximately 95 percent efficient.

It should be noted that the above figures are given as an example of an operative system, and that the 480 volt power supply was chosen because it is available at terminals for railroad tank cars, formerly also being used with the electrical resistance heaters. The impedance heating units according to the invention herein can be operated at substantially higher power levels without danger of burning out, and a primary limitation on heat production is the danger of the substance in the tank or vessel carbonizing on the outside of the outer conductor pipe.

Figure 6:
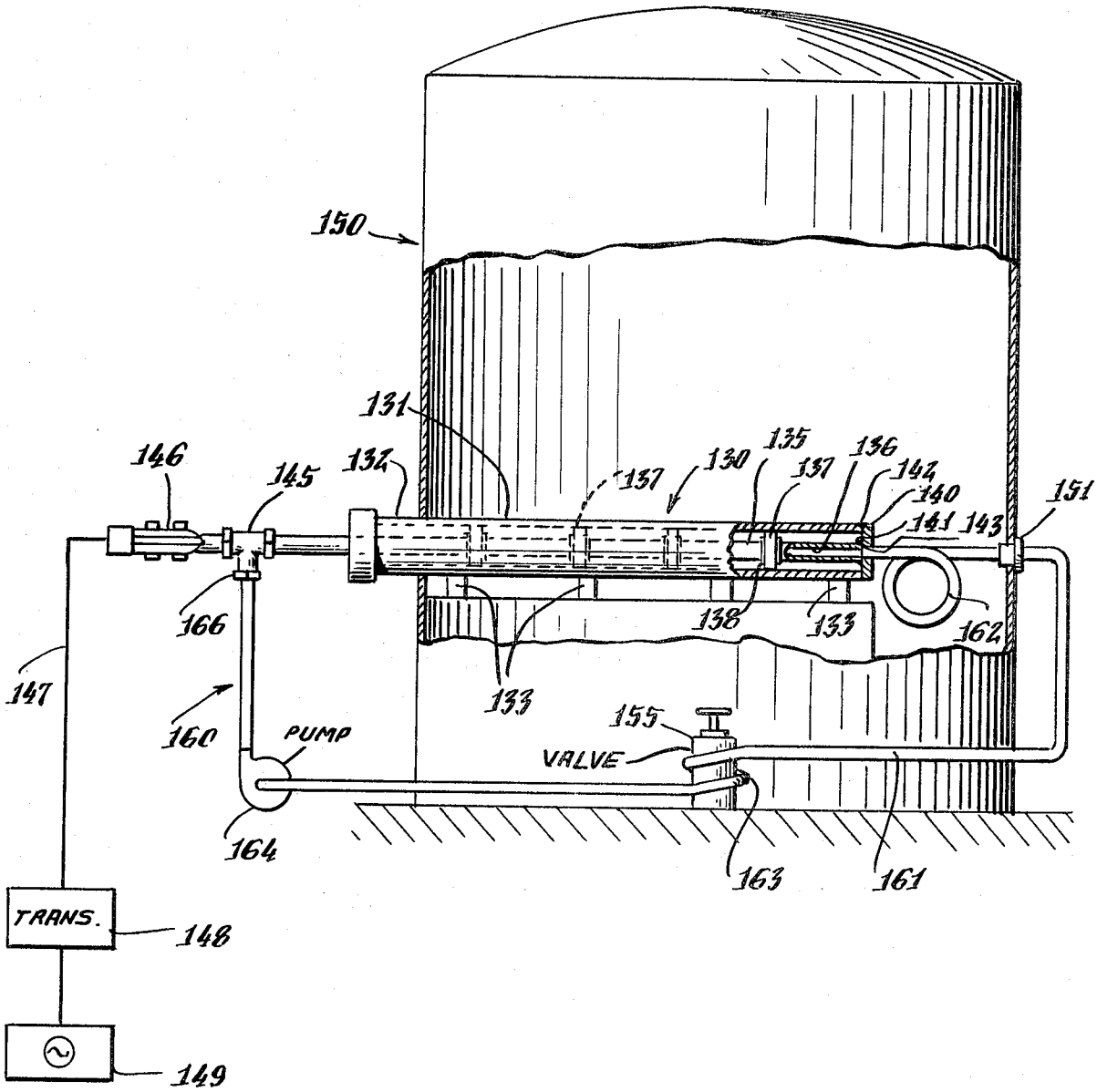
FIG. 6 is a side elevation view of an impedance heating system according to the invention herein and including a heat transfer fluid heating subsystem.
Figure 7:
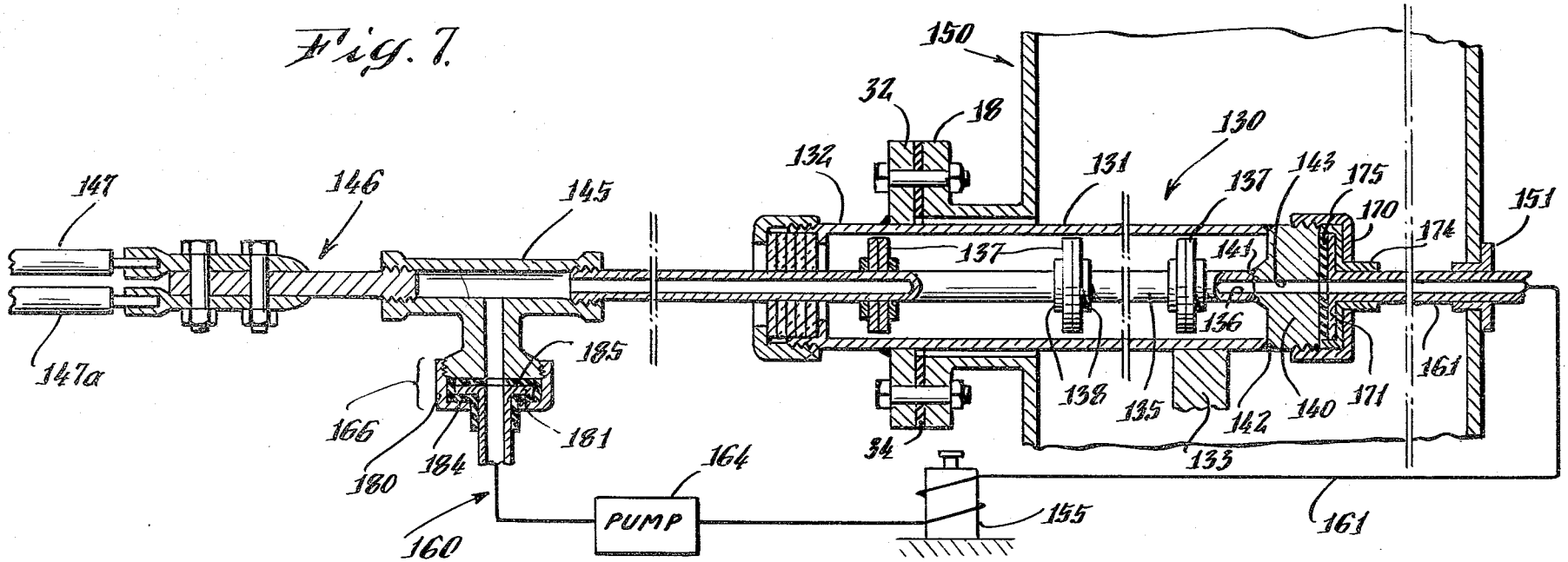
FIG. 7 is an enlarged longitudinal sectional view of one of the impedance heating units of the impedance heating system of FIG. 6.

Of course, the impedance heating system according to the invention herein is applicable to other tanks and vessels other than railroad tank cars, and with reference to FIGS. 6 and 7, an impedance heating unit 130 is shown installed in a stationary storage tank 150. FIGS. 6 and 7, illustrate a heat transfer fluid heating subsystem 160 used to provide for localized heating of a valve 155 (or other component) of the storage tank 150.

The impedance heating unit 130 is similar to the impedance heating unit 20 described above, and comprises an outer pipe conductor 131, one end 132 of which is secured at an opening in the wall of the tank 150 with most of the outer pipe conductor 131 extending into the interior of the tank 150. The outer pipe conductor 131 is supported within the tank by supports 133. A central conductor 135, which is a pipe having a central passage 136, is inserted into and supported concentrically within the outer conductor pipe 131 by insulation discs 137 held at spaced-apart intervals along the central conductor 135 by collars 138. The outer conductor pipe 131 and the central conductor pipe 135 are fabricated of ferromagnetic metal having relatively high resistivity, such as carbon steel, nickel or nickel steel alloys.

The outer conductor pipe 131 and inner conductor pipe 135 are electrically connected by an end plate 140, which is welded to the inner conductor pipe at 141 and to the outer conductor pipe at 142. The end plate 140 has an opening 143 aligned with the passage 136 in the central conductor pipe 135. At the opposite end of the central conductor pipe 135, a T fitting 145 is installed, whereby a flow path through the central passage 136 is provided. A terminal 146 is secured to the T fitting 145, and a cable 147, **147*a* connects the central conductor with a transformer 148 fed by a power supply 149**.

The heat transfer fluid subsystem 160 comprises a tube 161 which is secured to the end plate 140 with the central passage of the tube aligned with the opening 143 in the end plate 140. The tube 161 may be connected to the end cap 140 by providing it with an end flange 171 which is captured in an apertured cap nut 170 threaded onto the end plate 143. Shaped insulating members 174 and 175 both seal the connection and electrically isolate the tube 161 from the impedance heating unit 130. The tube may be coiled, as indicated at 162, to take up expansion of the impedance heating unit 130 and tube 161, and the tube 161 passes through a fitting 151 in the tank 150. The tube 161 is also coiled about the valve 155, as indicated at 163, and is connected to a pump 164. The opposite side of the pump 164 is connected to the T fitting 145 at 166, the connection 166 electrically isolating the T fitting from the pump. In this regard, the tube 161 is provided with a second end flange 181 which is captured in an apertured cap nut 180 threaded onto the depending leg of the T-fitting 145. Shaped insulating members 184 and 185 both seal the connection and isolate the tube 161 from the impedance heating unit 130. A heat transfer fluid is placed in the tube 161 and pump 164. When the impedance heating unit 130 is operated, the pump 164 may also be operated to circulate the heat transfer fluid, which is heated by its passage through the central conductor pipe 135. The heat is applied to the valve 155 at the coil 163 surrounding the valve, and this heats any of the substance in the tank which has solidified or become highly viscous in the valve, making it less viscous so that the valve can operate for withdrawing the substance from the tank. It will be appreciated that the heat transfer fluid heating subsystem 160 can be utilized to heat any other localized components, as required, or can be used to provide for more even heat distribution throughout the tank 150.

Figure 8:
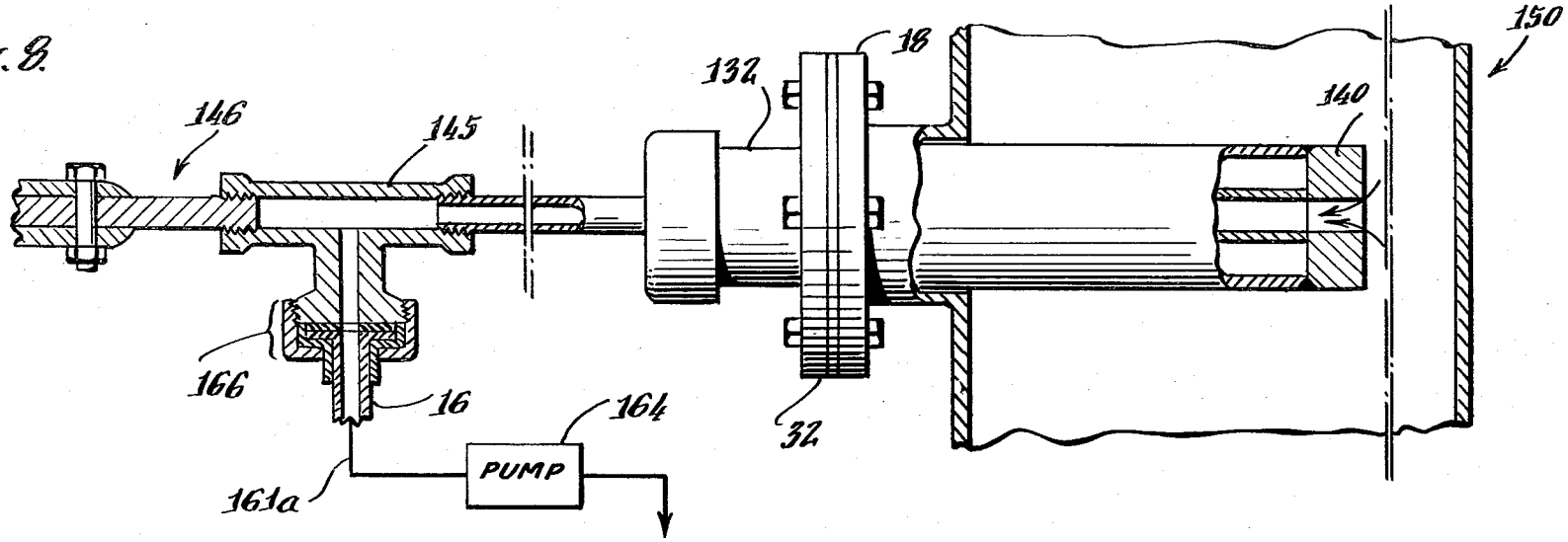
FIG. 8 is an enlarged view, partially in section, of another impedance heating system according to the invention herein.

Also according to the invention herein and illustrated in FIG. 8, the opening 143 in the end plate can be left open, and the substance within the tank 150 can be withdrawn through the central passage 136 of the central conductor pipe 135, and thereafter through the T-fitting 145 (as described above) and tube 161*a*, either by gravity or by use of pump 164, thereby withdrawing the substance in a well heated low viscosity state for further transportation through pipes or use. In this embodiment, the tube 161*a*, of course, does not return through the tank wall 151 to end plate 140.

It will be appreciated that the above description is of preferred embodiments of the invention, and various changes and modifications can be made by those skilled in the art without departing from the spirit and scope of the invention herein, which is limited only by the following claims.

I claim:

1. The combination of a tank for containing liquid and an impedance heating system for heating liquid in the tank, the combination comprising:

(A) a tank having a tank wall defining an interior space for containing a liquid;

said impedance heating system including at least one heating unit immersed in the liquid within the tank, each heating unit including:

(B) a rigid cylindrical outer pipe conductor, the first end of which is mounted to the tank wall at an opening in the tank wall, said mounting providing a liquid-tight seal between the tank wall and the exterior of the cylindrical outer pipe conductor, said outer pipe conductor extending into said tank and terminating at a second end therein which is spaced-apart from the tank wall, said outer pipe conductor being positioned to be immersed in liquid contained in the tank;

(C) means supporting the rigid outer pipe conductor within the tank;

(D) a conductive end cap secured to and sealing the second end of the outer pipe conductor;

(E) a rigid central conductor positioned within the outer pipe conductor, one end of the central conductor being secured to the conductive end cap whereby the end cap electrically connects the outer pipe conductor and the central conductor, the central conductor extending substantially the entire length of the outer pipe conductor;

(F) a plurality of temperature resistant electrical insulation discs each having an opening for passing the central conductor therethrough, the insulation discs being deployed at spaced-apart intervals along the central conductor and extending radially outwardly from the central conductor for supporting the central conductor away from the inside surface of the outer pipe conductor;

(G) collar means holding the insulation discs at spaced-apart intervals along the central conductor, said collar means including a plurality of pairs of metal collars, each pair of metal collars being secured to the central conductor and embracing therebetween at least one insulation disc, whereby the insulation discs are held in position on the central conductor as the central conductor with the insulation discs mounted thereon is inserted into the outer pipe conductor;

(H) a source of AC power, the outer pipe conductor and the central conductor being connected thereto in series, wherein the flow of alternating current causes impedance heating of both the outer pipe conductor and the central conductor as well as heating by reactance and hysteresis and eddy currents, the outer pipe conductor, end cap and central conductor having sufficient thickness that current flow therethrough is concentrated by skin effect on the inside surface of the outer pipe conductor and end cap and the outer surface of the central conductor, whereby the outside surfaces of the outer pipe conductor and end cap within the tank have substantially no voltage or current thereon, and the outer pipe conductor transfers heat generated to the contents of the tank.

2. The combination of a tank and an impedance heating system as defined in claim 1 wherein the rigid central conductor is a rod.

3. The combination of a tank and an impedance heating system as defined in claim 1 wherein the rigid central conductor is a pipe having a central passage therethrough.

4. An impedance heating system as defined in claim 3 wherein the end cap defines an opening therethrough aligned with the passage through the central conductor pipe and the central conductor pipe is provided with a T fitting at its end opposite the end cap, whereby the substance within the tank can be withdrawn through the central conductor, the substance being heated as it passes therethrough.

5. An impedance heating system as defined in claim 4 and further comprising:

(I) a tube connected to the opening in the end cap and to a pump, the pump also being connected to the T fitting at the opposite end of the central conductor pipe; and (J) a heat transfer medium contained in the tube, pump and central conductor pipe, wherein the pump circulates the heat transfer medium, the heat transfer medium is heated in the passage in the central conductor pipe, and the tube delivers the heated heat transfer medium to a desired area of heat application.

6. The combination of a tank and an impedance heating system as defined in claim 1 wherein the outer pipe conductor and central conductor are fabricated of carbon steel.

7. The combination of a tank and an impedance heating system as defined in claim 1 wherein the metal collars flanking the insulation discs are welded to the central conductor.

8. The combination of a tank and an impedance heating system as defined in claim 7 wherein the insulation discs are asbestos.

9. The combination of a tank and an impedance heating system as defined in claim 8 wherein a plurality of insulation discs are mounted between the flanking collars at each of the spaced-apart intervals along the central conductor.

10. The combination of a tank and an impedance heating system as defined in claim 1 wherein the insulation discs are asbestos.

11. The combination of a tank and an impedance heating system as defined in claim 1 wherein the central conductor protrudes from the first end of the outer pipe conductor, and the protruding end of the central conductor has a terminal welded thereto for receiving an electric insulated conductor cable connecting the central conductor to the AC power supply.

12. The combination of a tank and an impedance heating system as defined in claim 11 wherein the first end of the outer pipe conductor protrudes outwardly from the tank wall and further comprising:

(I) an apertured cap nut received on the first end of the outer pipe conductor, the apertured cap nut loosely securing a plurality of apertured insulation discs at the end of the outer pipe conductor for inhibiting the ingress of contaminents, the central conductor protruding through the apertured insulation discs and the aperture of the apertured cap nut.

13. The combination of a tank and an impedance heating system as defined in claim 1 wherein the AC power supply is grounded to the tank and the outer pipe conductor is also grounded to the tank.

14. The combination of a tank and an impedance heating system as defined in claim 1 wherein the impedance heating system comprises a plurality of such heating units provided within said tank, said heating units being electrically connected in parallel with each other to said AC power source.

15. The combination of a tank and an impedance heating system as defined in claim 14 wherein the number of such heating units is a multiple of three and the AC power supply is a three-phase AC power supply including:

(I) a three-phase transformer having its primary windings connected to the power supply and having its secondary windings connected to the plurality of central conductors respectively mounted in the outer pipe conductors of the heating units, the central conductors being balanced among the secondary windings of the three-phase transformer, the secondary windings and the outer pipe conductors having a common ground.

* * * * *